US006183310B1

(12) United States Patent
Shu

(10) Patent No.: US 6,183,310 B1
(45) Date of Patent: Feb. 6, 2001

(54) LIGHT BULB WITHOUT CONNECTION TERMINALS USED FOR CHRISTMAS DECORATIVE LAMPS

(76) Inventor: Kuo Fen Shu, No. 10, Lane 198, Chung Cheng Road, Hsinchu (TW)

( * ) Notice: Under 35 U.S.C. 154(b), the term of this patent shall be extended for 0 days.

(21) Appl. No.: 09/426,890

(22) Filed: Oct. 26, 1999

(51) Int. Cl.[7] ..... H01R 17/00
(52) U.S. Cl. ..... 439/699.2
(58) Field of Search ..... 439/699.2, 699.1, 439/336, 356, 617; 362/226

(56) References Cited

U.S. PATENT DOCUMENTS 5,681,107 * 10/1997 Wang ..... 362/249
5,720,544 * 2/1998 Shu .
5,722,860 * 3/1998 Pan ..... 439/619

* cited by examiner

*Primary Examiner*—Gary F. Paumen
*Assistant Examiner*—Phuongchi Nguyen
(74) *Attorney, Agent, or Firm*—Rosenberg, Klein & Lee

(57) ABSTRACT

A light bulb holder structure in which there is no need for connection terminals. The holder is especially suitable for LED type light bulbs. It primarily comprises a coupling element seated therein. Electrical wire's bare conductive ends are disposed on two sides of the coupling element to get in touch with the leads of a light emitted diode that is seated on the top of the holder with leads extending into two vertical openings of the coupling element. The holder according to the invention can provide excellent electrical contacts and sturdy combination between light emitted diodes and electrical wires.

1 Claim, 4 Drawing Sheets

LIGHT BULB WITHOUT CONNECTION TERMINALS USED FOR CHRISTMAS DECORATIVE LAMPS

BACKGROUND OF THE INVENTION

Conventional holders used for Christmas decorative light bulbs typically used a pair of terminal plates connected with the exposed conductive ends of an electrical wire. The terminal plates further get in touch with the leads of a light emitted diode or an incandescent lamp to form an electrical connection. Typically the terminal plate is joined with conductor wires by clamping. However, clamping forces are limited and so dropping of electrical wires or a poor electrical contact was often found.

In view of the above problems, the present invention is to provide an improved holder structure in which there is no needs for terminals and so the drawbacks of a conventional holder are removed. It has practical value in industry. Now the features and structure of the invention will be detailed with reference to the accompanying drawings.

BRIEF DESCRIPTION OF THE ACCOMPANYING DRAWINGS

DETAILED DESCRIPTION OF PREFERRED EMBODIMENTS

Figure 1:
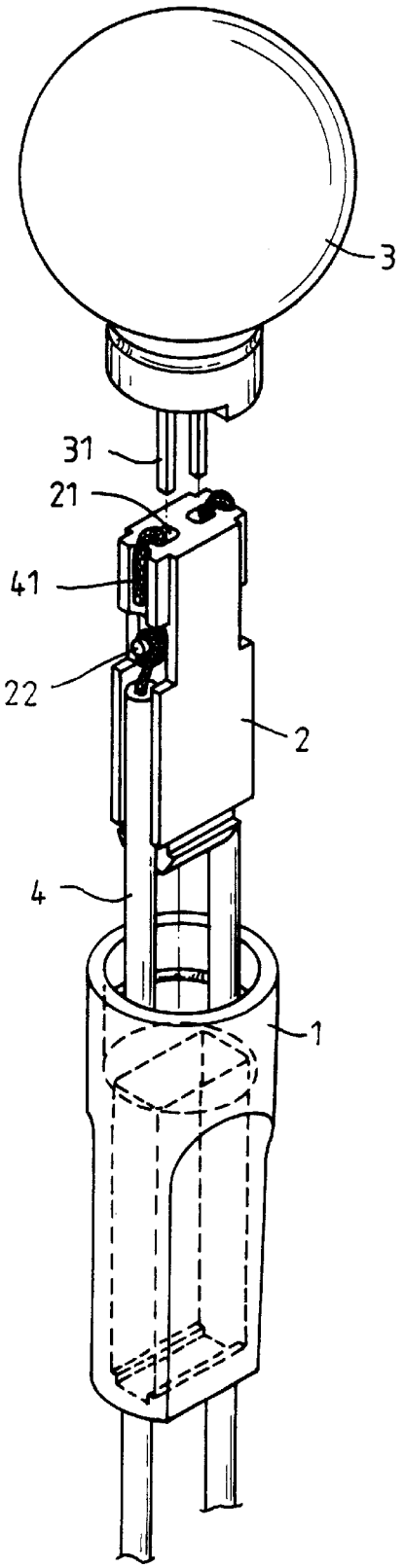
FIG. 1 is a perspective exploded view showing an embodiment of the holder according to the invention.
Figure 2:
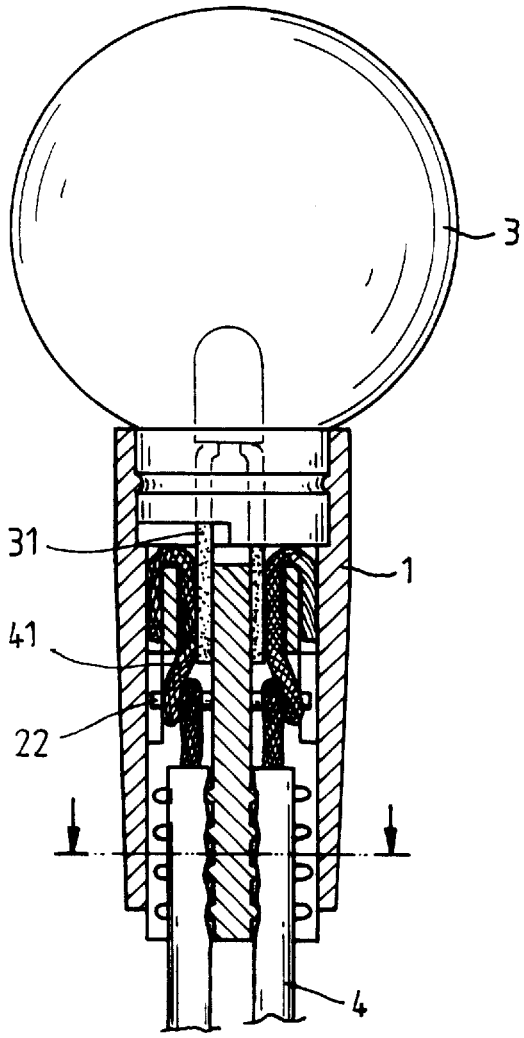
FIG. 2 is a cross sectional view showing the holder of FIG. 1 in an assembled state.

With reference to FIGS. 1 and 2, the light bulb holder of the present invention comprises a holder body (1), a coupling element (2) and a light emitted diode (3). The coupling element (2) is suitable to be seated inside the holder body (1). A light emitted diode (3) can be received and secured on the top of the holder body (1), with two leads each extending into two vertical openings (21) of the coupling element (2). The coupling element (2) is provided on two opposite sides with a projecting pin (22). Two electrical wires (4) are respectively disposed on two sides of the coupling element (2) by wrapping an exposed conductive end (41) of the electrical wire (4) around the projecting pin (22) and then upwardly extending through vertical holes (21). After that, the bared conductive ends are finally bent inversely to the downward direction and seated on one side of the coupling element (2).

In the holder structure according to the invention, the conductive wire ends (41) can be in effective electrical contact with the leads (31) of a light emitted diode (3) without any possibility of slipping off. Besides, there is no use of any terminal plate in the holder and thus it can avoid the problem of terminal's slipping off while considerably reducing manufacturing costs. This fact greatly enhances its practical value in the industry.

Figure 3:
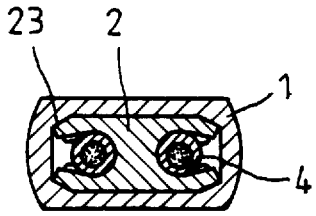
FIG. 3 is a cross sectional view showing a variant of the coupling element according to the invention.

As shown in FIG. 3, formed on four inner corners of the coupling element (2) can be a chamfer (23) that provides a squeeze force to hold electrical wires (4) to attain a more effective combination after the coupling element (2) is inserted into the holder body (1).

Figure 4:
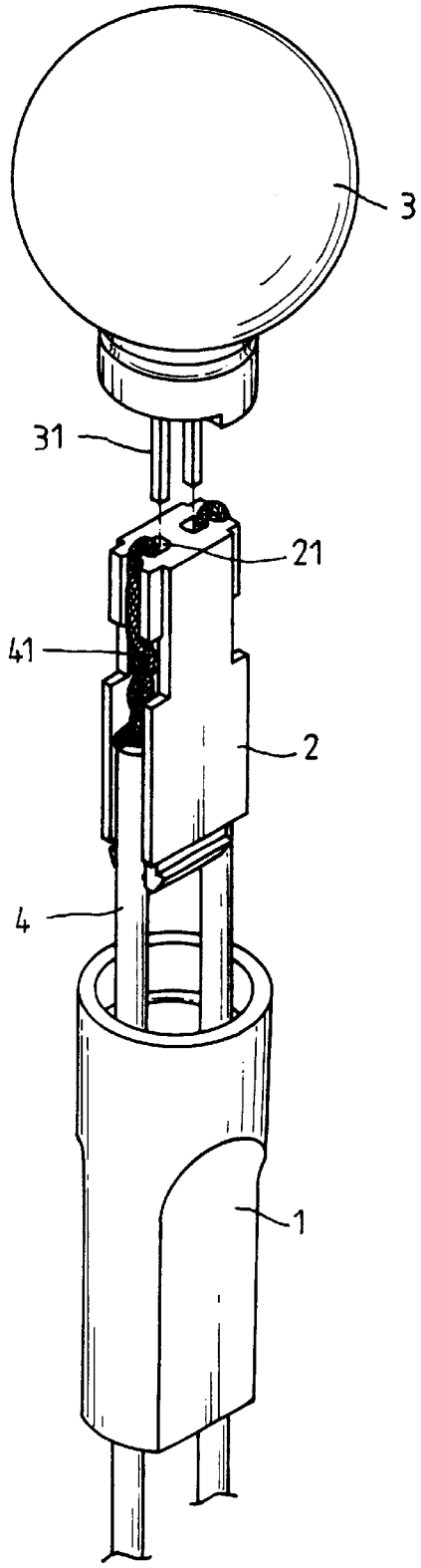
FIG. 4 illustrates another embodiment of electrical wires tied to a terminal according to the present invention.

FIG. 4 shows another variant of the above-mentioned embodiment of the invention. In the structure, the coupling element (4) does not have projecting pins on its sides. An electrical wire's bare conductive end (41) passes through a vertical opening (21) instead of being wrapped around projecting pins. Then the conductive end is further intertwined with a length of electrical wire that stays outside the inlet end of the vertical opening to reach a fixing effect. This method can also achieve the goal of the invention.

Figure 5:
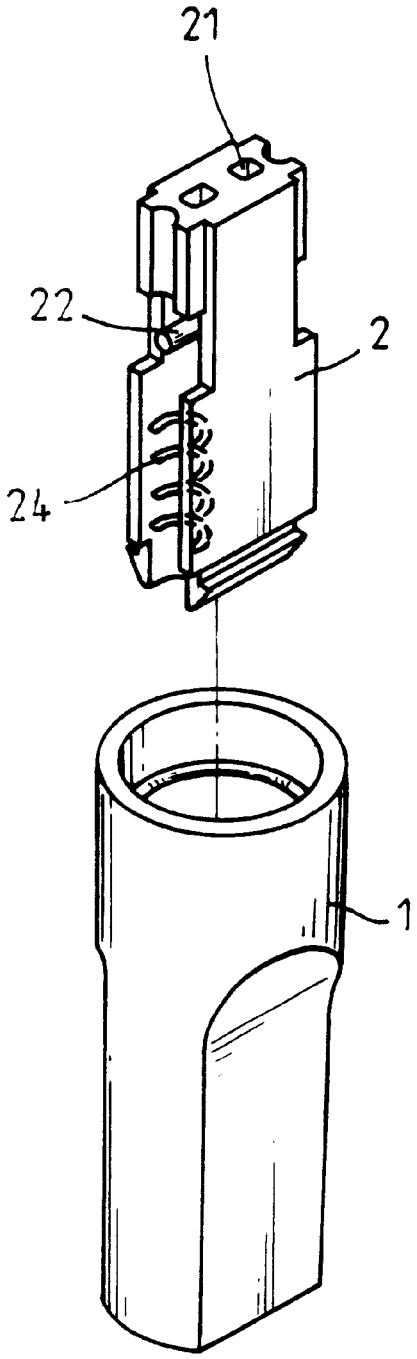
FIG. 5 is an exploded perspective view showing the holder and the coupling element according to the present invention.

FIG. 5 shows another embodiment of the invention, in which the coupling element (2) is provided with a plurality of parallel ribs in the slots formed on two opposite sides thereof. When an electrical wire is seated in the slots, those ribs give additional squeezes, which not only reinforces fastening strength but also provides a waterproof function.

What is claimed is:

1. A holder structure without connection terminals used for Christmas decorative light bulbs comprising:

a holder body adapted for receiving a light bulb or a light emitting diode in a first end thereof;

a coupling element inserted into a second end of said holder body, said coupling element having a pair of longitudinally directed openings formed in one end thereof for respectively receiving a pair of leads of a light bulb or light emitting diode therein; and two electrical wires disposed on two opposite sides of the coupling element, each of said electrical wires having an extended bared conductive end extending through a respective one of said longitudinally directed openings and being bent over said one end of said coupling element, each said bared conductive end being in contiguous contact with a corresponding lead of a light bulb or a light emitting diode within a respective one of said longitudinally directed openings to form an electrical connection therewith, said coupling element including a pair of projecting pins respectively extending from opposing sides of said coupling element, each said bared conductive end of said electrical wires having an intermediate portion wrapped around a respective one of said projecting pins.

* * * * *